US005229178A

United States Patent [19]

Zemitis

[11] Patent Number: 5,229,178

[45] Date of Patent: Jul. 20, 1993

[54] ELASTIC CORD APPARATUS COMPRISING AN ELASTIC CORD, SERVING AND BINDING

[76] Inventor: Martin S. Zemitis, P.O. Box 974, Davis, Calif. 95617-00974

[21] Appl. No.: 773,015

[22] Filed: Oct. 8, 1991

[51] Int. Cl.[5] ..... D04D 1/02; A44B 11/02; F16G 9/04; D02G 3/36

[52] U.S. Cl. ..... 428/37; 24/115 K; 24/128; 24/136 K; 24/136 R; 24/300; 24/301; 57/225; 57/230; 100/1; 100/9; 289/1.2; 289/18.1; 428/364; 428/375; 428/377; 428/908.8; 428/222; 428/224; 428/225; 428/230

[58] Field of Search ..... 100/1, 9; 57/225, 230; 289/1.2, 18.1; 24/300, 301, 115 K, 128, 136 R, 136 K; 428/37, 375, 377, 908.8, 364, 222, 224, 230, 225

[56] References Cited

U.S. PATENT DOCUMENTS 3,565,424 2/1971 Macabet ..... 482/131
4,885,824 12/1989 Schwab et al. ..... 24/17 B

*Primary Examiner*—George F. Lesmes
*Assistant Examiner*—James D. Withers
*Attorney, Agent, or Firm*—Thomas R. Lampe

[57] ABSTRACT

The combination of a shock cord including a shock cord loop at an end thereof, a serving tightly disposed about the shock cord immediately adjacent to the shock cord loop, and a binding tightly disposed about the serving and connected to the serving and shock cord.

7 Claims, 6 Drawing Sheets

ELASTIC CORD APPARATUS COMPRISING AN ELASTIC CORD, SERVING AND BINDING

TECHNICAL FIELD

This invention relates to elastic cord apparatus and a method of making same. More particularly, the apparatus is directed to an improved binding at the loop end of the cord. The apparatus has application to shock cords utilized in the sport of bungee jumping wherein a serving is disposed about the shock cord. However, the teachings of the present invention may be utilized in connection with elastic cord employed for virtually any purpose.

BACKGROUND ART

The sport of bungee jumping is becoming increasingly popular. When practicing the sport, an individual wears a harness attached to an end of a shock cord, the other end of the shock cord being attached to an elevated structure. The bungee jumper, while the shock cord is slack, jumps from an elevated position. The length of the shock cord, or bungee cord as it is commonly known, is such that it stretches at the end of the fall to arrest the downward movement of the jumper. The inherent resiliency of the shock cord then causes upward rebound of the jumper.

Conventionally, shock or bungee cords are looped at their ends with a serving or whipping being employed to maintain such configuration and prevent the loop from opening under stress. Servings or whippings commonly are formed of nylon cord or strings knotted about the shock cord adjacent the shock cord loop.

The present invention relates to an elastic cord featuring an improved binding. The binding may be employed in conjunction with a shock cord serving as a safety back-up and protective cover therefore. The invention is also applicable to single or multi-strand elastic cords not incorporating servings to secure loops formed in such cords. Utilizing the teachings of the present invention, a secure, self-cinching binding is provided.

DISCLOSURE OF INVENTION

The present invention relates to an apparatus including an elastic cord having a loop formed therein and a binding of a particular character which is employed to secure the loop. The embodiment of the invention disclosed herein includes a shock cord, a serving, and a binding which serves to protect the serving from abrasion and the potentially harmful affects of ultraviolet rays. The binding does not adversely affect the performance of the shock cord and serving but actually enhances the strength and safety thereof.

The apparatus of the invention as disclosed herein includes a shock cord having a distal end including a first distal end portion defining a shock cord loop and a second distal end portion disposed in engagement with a segment of the shock cord and parallel thereto.

A serving is tightly disposed about the second distal end portion and the shock cord segment immediately adjacent to the shock cord loop.

A binding is tightly disposed about the serving and secured to the serving and shock cord.

The binding incorporates a safety loop for operative attachment to a bungee jumping harness. The binding comprises an elongated strap wound about the serving and forming a plurality of at least partially overlapping convolutions. The strap is preferably formed of woven material such as nylon. The safety loop of the apparatus is disposed adjacent to the shock cord loop. and is at least twice the length of the shock cord loop.

According to the method of the disclosed invention, a binding is applied to a shock cord about a serving affixed to the shock cord adjacent to a looped shock cord end, said serving having been affixed to the shock cord with the shock cord under end-wise tension and in a stretched condition of a first degree of magnitude.

The end-wise tension on the shock cord is partially released whereby the shock cord attains a stretched condition of a second degree of magnitude less than the first degree of magnitude.

Simultaneously with the step of partially releasing the end-wise tension on the shock cord, the serving is tightened about the shock cord.

After the step of partially releasing the end-wise tension on the shock cord, a binding is disposed about the serving. After this step has been accomplished, the end-wise tension on the shock cord is completely released with the binding disposed about the serving.

As stated above, the binding is formed from an elongated strap. The step of disposing the binding about the serving includes winding the elongated strap about the serving to form a plurality of at least partially overlapping convolutions.

A safety loop is formed in the strap after forming the convolutions.

Other features, advantages, and objects of the present invention will become apparent with reference to the following description and accompanying drawings.

BEST MODE FOR CARRYING OUT THE INVENTION

Figure 1:
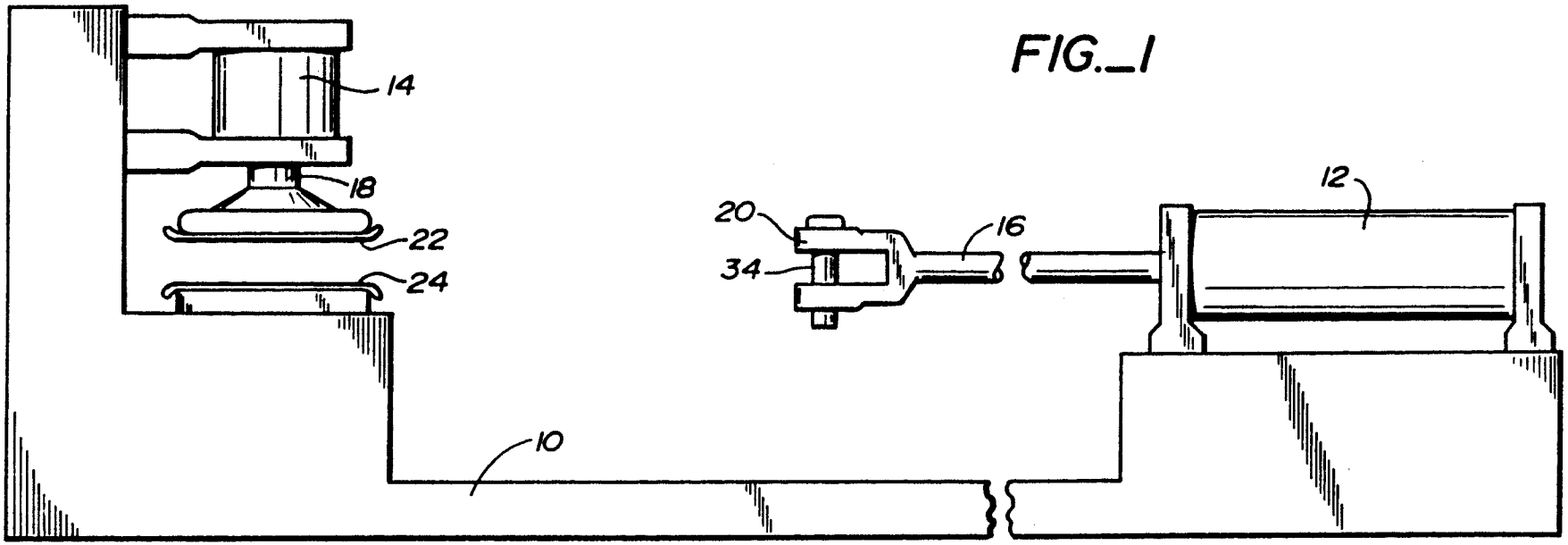
FIG. 1 is a side elevation view of a device employed in the manufacture of the apparatus of the present invention and to practice the method thereof.

FIG. 1 illustrates somewhat schematically a machine employed to construct the apparatus of the present invention and practice the method thereof. The machine includes a base 10. Mounted on the base at one end thereof is a cylinder 12 disposed in a generally horizonal direction. At the other end of the base a cylinder 14 is mounted in a vertical orientation. Cylinders 12 and 14 may be either hydraulic or pneumatic cylinders.

Cylinder 12 includes an extensible arm 16 while cylinder 14 includes an extensible arm 18. A clevis 20 having a pin 34 is affixed to the end of arm 16, while arm 18 terminates at an upper clamp element 22. A lower clamp element 24 is disposed below clamp element 22.

Figure 2:
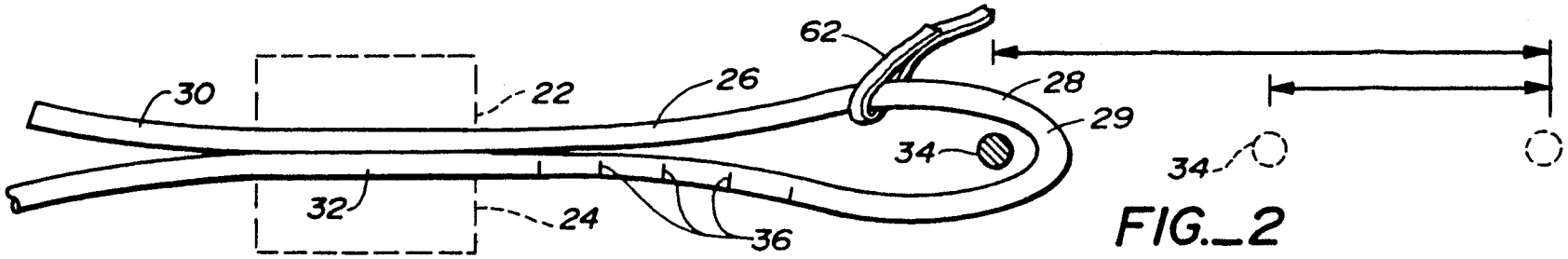
FIGS. 2 and 3 are top plan views of a looped end of a shock cord in two alternative configurations attained thereby during manufacture of the present apparatus.

Referring now to FIG. 2, the end of an elastic cord in the form of a bungee cord or shock cord 26 is shown. This distal end of the shock cord includes a first distal end portion 28 defining a shock cord loop 29 and a second distal end portion 30 which is doubled back and positioned in engagement with a segment 32 of the shock cord and parallel thereto.

Figure 3:
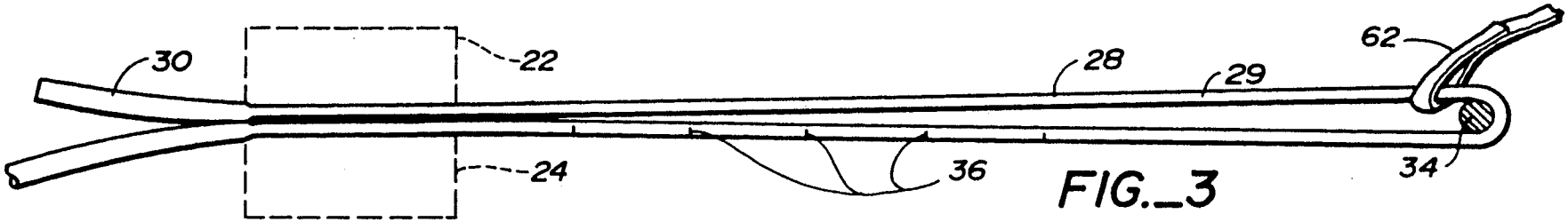

Second distal end portion 30 and segment 32 are positioned between clamp elements 22, 24, said clamp elements being designated by dash lines in FIG. 2. FIG. 3 shows the clamp elements 22, 24 clamping the shock cord.

Referring once again to FIG. 2, the pin 34 of clevis 20 is inserted through the shock cord loop 29 formed by first distal end portion 28 when the arm 16 is extended. In FIG. 2, the position of the pin 34 when the arm 16 is extended is shown in solid lines while two alternative positions wherein the arm is retracted are shown by dash lines.

The shock cord 26 is stretched as shown in FIG. 3 by retracting the arm 16 and moving the pin 34 to the position illustrated in solid lines in FIG. 3. It is preferred that the loop be stretched in the order of 50 to 1,000 per cent of its unstretched length. Indicia such as lines 36 may be imprinted on the outer sheath of the shock cord to show the degree of stretch.

Figure 4:
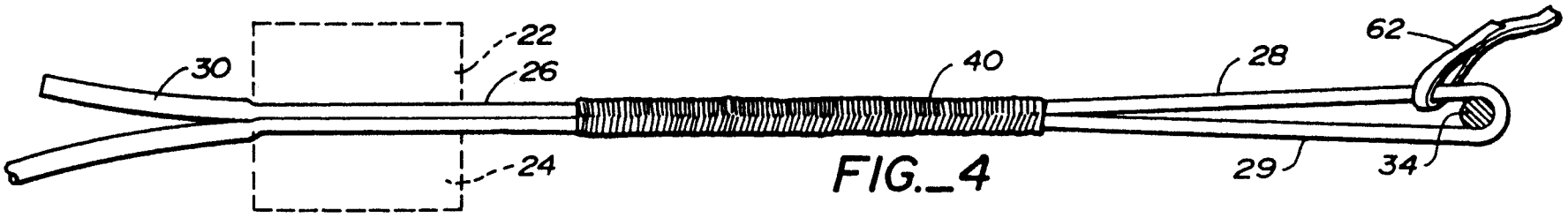
FIG. 4 illustrates the cord in fully stretched condition by the apparatus of FIG. 1 with a serving disposed thereabout.

Referring to FIG. 4, a serving 40 is wrapped about and secured to shock cord 26 when the shock cord loop 29 is stretched to the degree indicated in FIG. 3 and 4. Details of the serving will not be described in depth since servings or whippings employed to maintain a loop at the end of a shock cord are well known expedients. Suffice it to say, that the serving comprises a plurality of cord bights or loops wrapped about and knotted or otherwise secured to the shock cord. Nylon cordage is a common expedient employed to form a serving.

Figure 5:
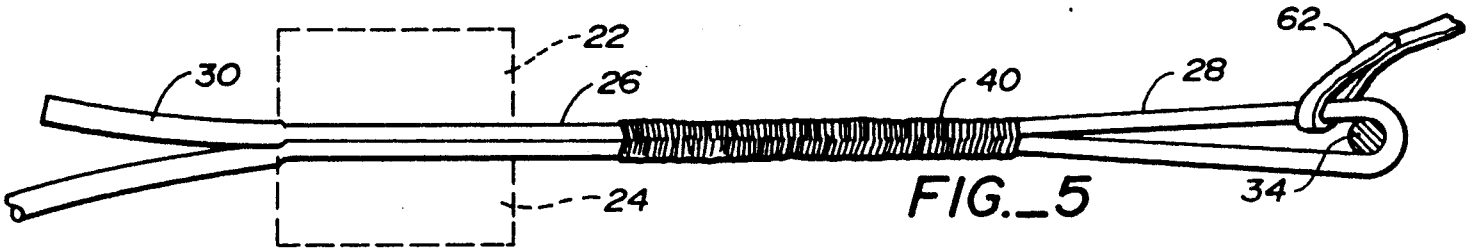
FIG. 5 is a view similar to FIG. 4 but illustrating the shock cord under a lesser degree of tension.

The end-wise tension applied to the shock cord by the clamp elements and the clevis is now partially released by extending arm 16 of the cylinder 12. This condition is illustrated in FIG. 5. According to the teachings of the present invention, it is preferred that the tension be relaxed by allowing the shock cord length to be reduced to a lesser degree of stretch.

According to the teachings of the present invention, in the embodiment disclosed, a binding is tightly disposed about the serving to further bind the cord as well as protect the serving from exposure to ultraviolet light and abrasion. The binding is formed from an elongated strap 50 having a length sufficient to carry out the steps which will now be described and which are illustrated in the drawing figures commencing with FIG. 6. In such figures the strap is designated by reference numeral 50 and has two ends A and B. For the purpose of simplicity and illustration, such ends in FIG. 6 and subsequent figures are shown greatly abbreviated.

Figure 6:
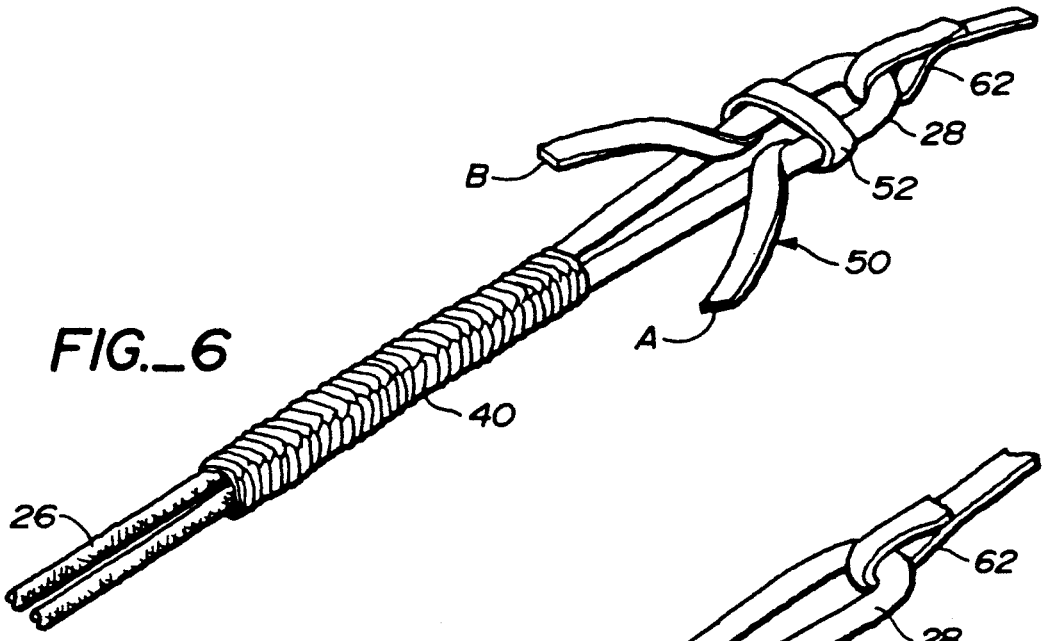
FIGS. 6 and 7 are perspective views of an end of the shock cord illustrating sequential steps during application of a strap to form a binding over the serving.

In FIG. 6 the strap 50 is configured so that it forms a bight 52 and wraps about the shock cord loop with the ends A, B of the strap passing outwardly through the loop. That bight portion of the strap disposed about the shock cord loop is slid adjacent to the end of serving 40 but remains in engagement with the shock cord.

Figure 7:
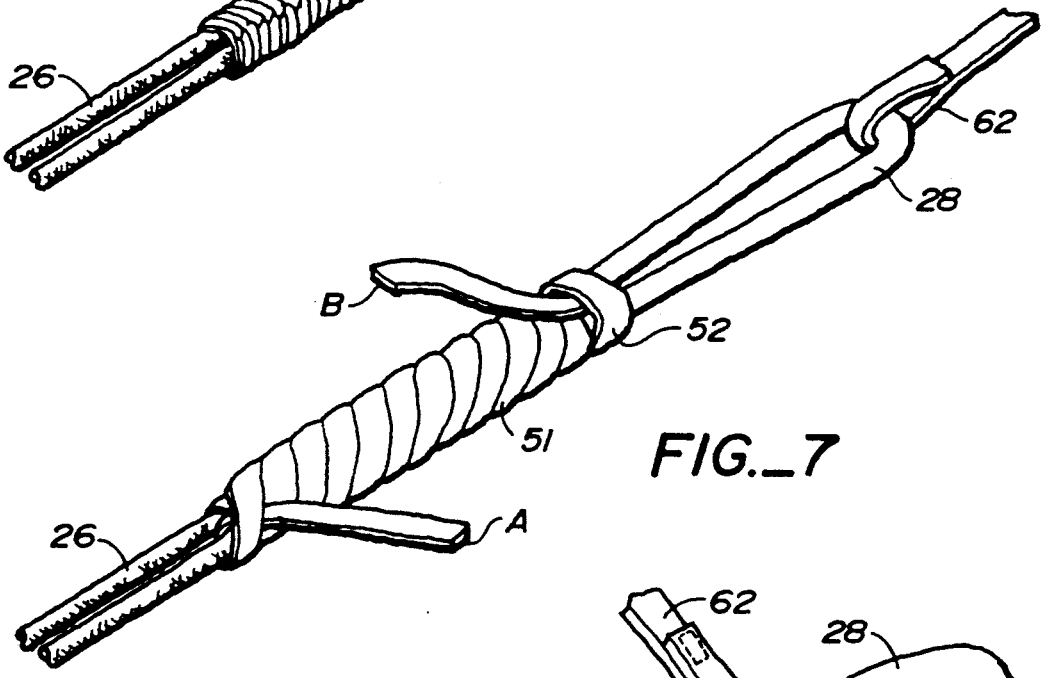

Next, end A of the strap 50 (which may be formed of nylon webbing or the like) is spirally wound to form spiral windings 51 over the serving 40 as shown in FIG. 7, the end A being passed under itself, as shown, about the shock cord adjacent the inner end of the serving.

The end A is then pulled tight to secure it into position relative to the shock cord by the person fabricating the cover.

Figure 8:
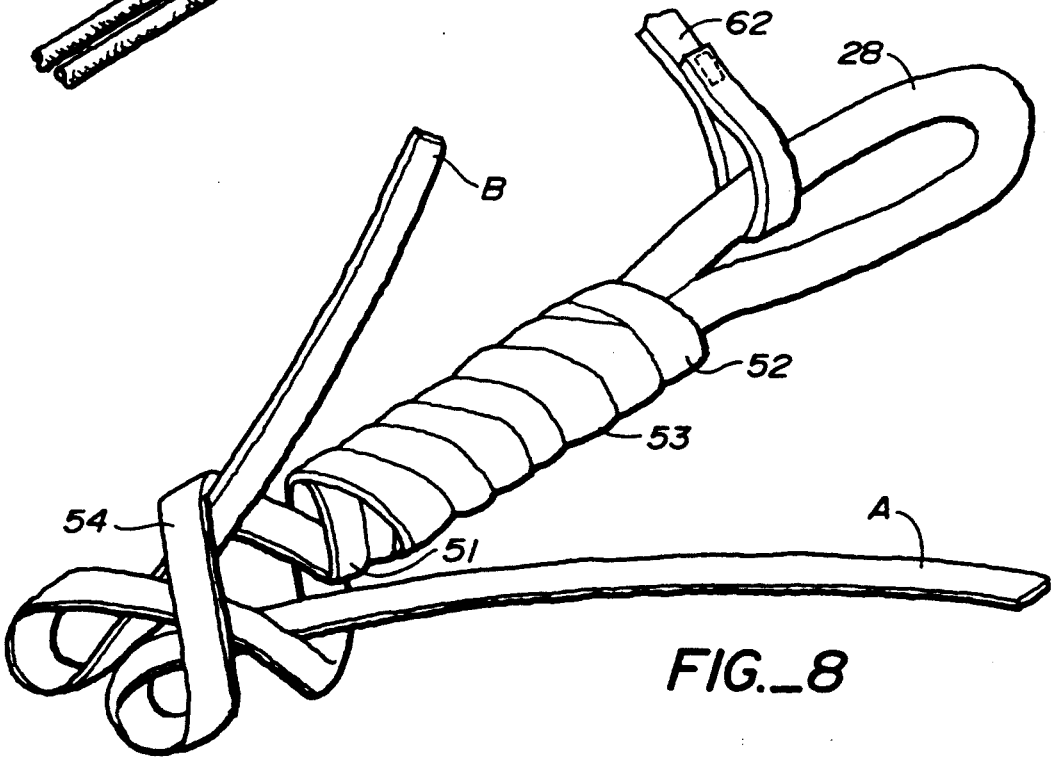
FIG. 8 is an enlarged diagrammatic view of a portion of the shock cord end and showing details of the binding strap at a subsequent stage of binding formation.

Next, end B of the strap 50 is spirally wound over the spirals of end A in an opposed direction to form spiral windings 53. This is shown in FIG. 8. In FIG. 8 the shock cord is not shown at the left of the Figure so that details of the strap and the relative positioning of ends A and B can be seen. After the spirals 53 of end B have passed beyond the inner end of serving 40 (not shown in FIG. 8) the ends A, B are manipulated as shown in FIG. 8 and cinched tight into position relative to both end A and the shock cord 26 to form a bight or loop 54.

Figure 9:
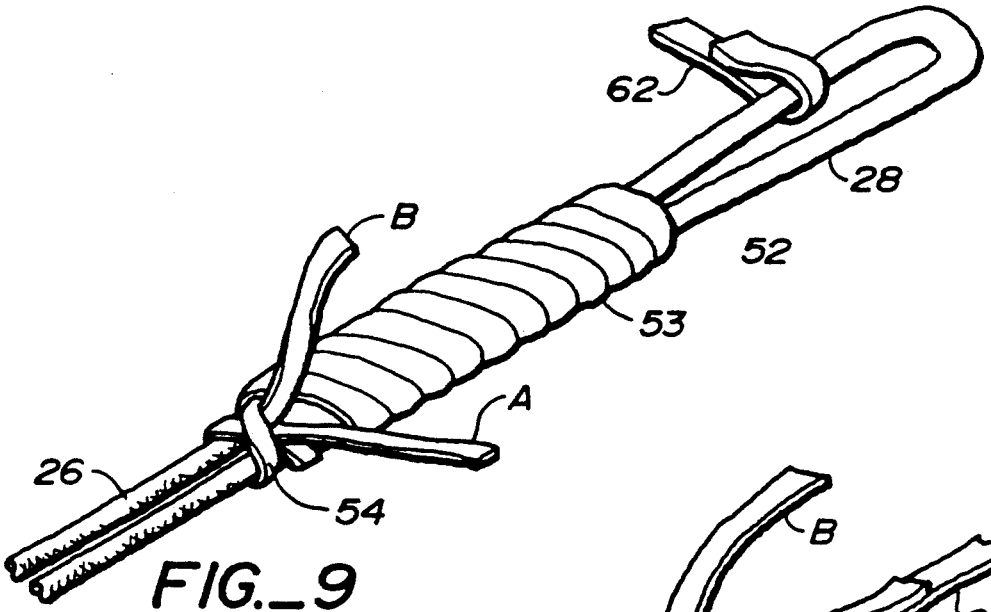
FIGS. 9 and 10 are views similar to FIGS. 6 and 7 but showing the final sequential step in formation of the binding.
Figure 10:
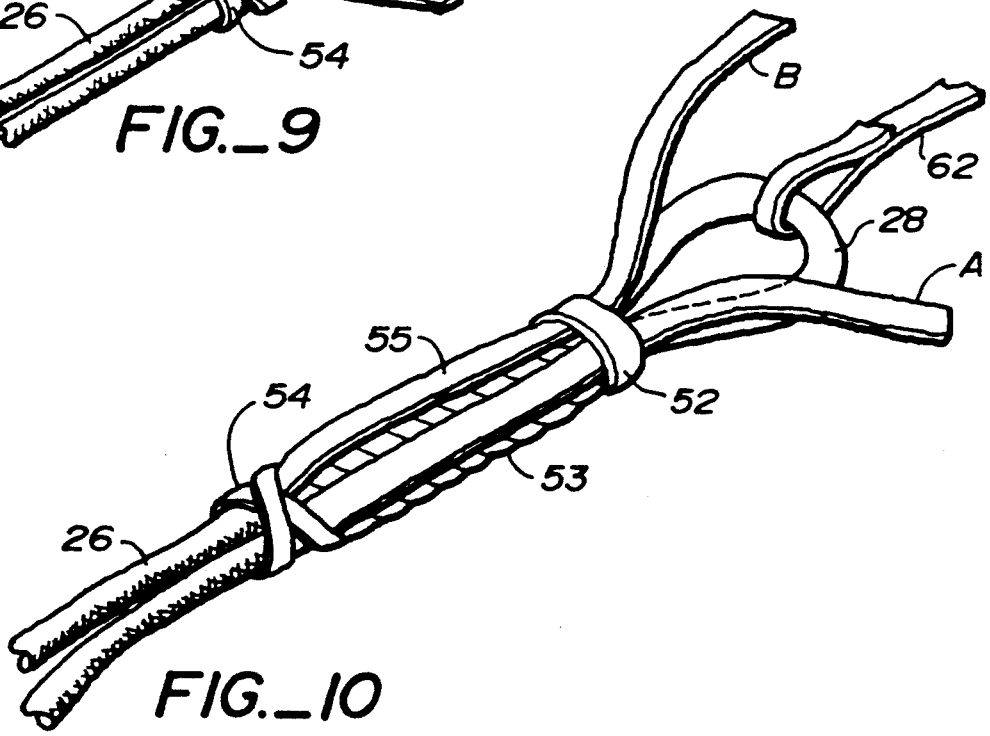

As shown in FIGS. 9 and 10 ends A and B are manipulated back along the length of the serving as well as their own spirally wound convolutions or windings 51, 53 and brought under the bight or loop 52 formed in the strap which was originally formed as shown in FIG. 6 about the shock cord loop. The reference numeral 55 indicates return of the ends.

The end-wise tensile forces on the shock cord are now completely released by extending arm 16 of cylinder 12. This results in a contraction of the shock cord, further shortening of the serving 10 and a bunching up of the overlapping convolutions of the binding which is designated by reference numeral 54. This creates not only an attractive appearance but it assures that the binding completely enshrouds and encapsulates the serving so that the serving is protected by the cover. Furthermore, the shock cord will expand to its original thickness when end-wise tensile forces are released. This will cause the strap to even more tightly bindingly engage the shock cord adjacent opposed ends of the serving. That is, the bights 52 and 54 are tightly knotted about the cord at two locations on the cord, forming a secure double knot between the binding and the cord.

The binding is of a self-cinching character. The greater the opposed forces applied to the ends thereof, the more the binding is snugged against the cord. In other words, end-wise pulling forces applied to the binding ends lock the binding in place.

Figure 11:
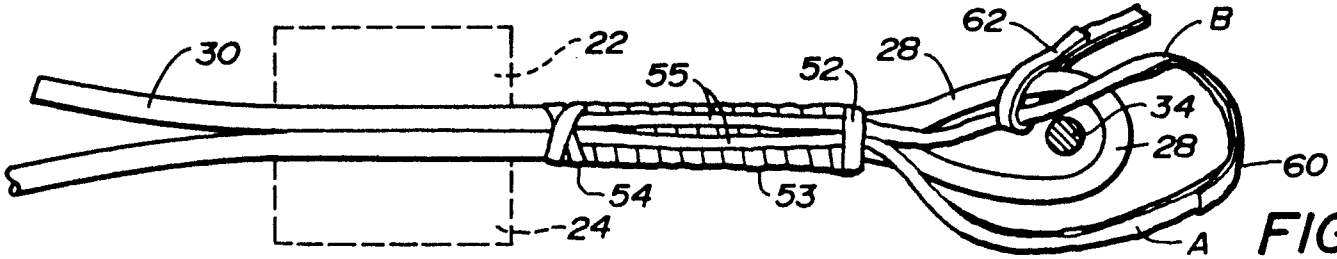
FIG. 11 is a top plan view of the assembled shock cord, serving and binding.

The ends A and B are then secured together to form a safety loop 60. This may simply be done by a knot or, alternatively, the ends A and B may be sewn together. This is shown in FIG. 11.

Figure 12:
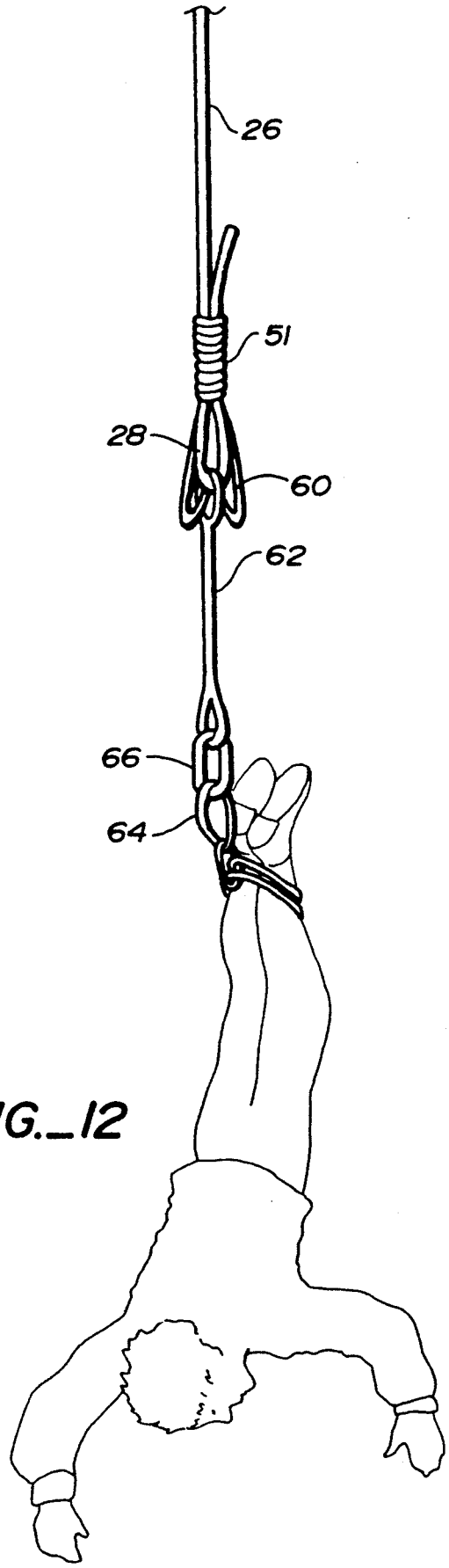
FIG. 12 is a pictorial view of a user suspended from a harness at the end of apparatus constructed in accordance with the teachings of the present invention.

The safety loop 60 is disposed adjacent to the shock cord loop 29 defined by first distal end portion 28. The safety loop 60 is passed through the same strapping 62 which encompasses the shock cord loop and is operatively connected to a bungee jumping harness 64 shown rather diagrammatically in FIG. 12. When the shock cord stretches at the end of the jump, the safety loop must be of such a length as not to impede the normal stretching of the shock cord loop 29.

The strap 50 may be formed of any suitable material; however as stated above, woven nylon material has been found to be one such suitable material.

Once the binding 54 is formed as described above, it is tightly secured into position relative to the shock cord and the serving. The cover strap 50 is in direct binding engagement with the shock cord adjacent opposed ends of the serving so that the cover cannot move relative thereto. And, as stated above, pulling forces will only tend to secure the relationship.

The safety loop 60 projects outwardly from the nip formed by the strap convolution or bight 52 under which it passes and tensile forces on the safety loop merely cause tightening of the binding in place by tightening the strap at the ends of the serving. When the end-wise tension was fully released from the shock cord after assembly of the binding, the shock cord projecting from the ends of the serving will again expand and ensure maintenance of a tightly bound, fixed relationship between the shock cord and the cove strap.

I claim:

1. In combination:

an elastic cord having a distal end including a first distal end portion defining a cord loop and a second distal end portion disposed in engagement with a segment of said elastic cord and parallel thereto;

a serving disposed about said elastic cord; immediately adjacent to said cord loop and a binding tightly disposed about said serving, said binding comprising an elongated strap having a plurality of at least partially overlapping convolutions bunched together when said cord is free of end-wise external forces, said binding being of a self-cinching character whereby application of opposed end-wise forces thereto will lock the binding into tighter engagement with said elastic cord.

2. The combination according to claim 1 wherein said binding comprises an elongated strap wound about said serving and forming a plurality of at least partially overlapping convolutions.

3. The combination according to claim 1 wherein said binding includes a safety loop disposed adjacent to said cord loop.

4. The combination according to claim 2 wherein said elongated strap is formed of woven material.

5. The combination according to claim 3 wherein said safety loop projects outwardly from a nip defined by at least one of said at least partially overlapping convolutions.

6. The combination according to claim 2 wherein said elongated strap bindingly engages said elastic cord adjacent opposed ends of said serving.

7. The combination according to claim 1 wherein said elongated strap defines two spaced knots in tight engagement with said cord.

* * * * *